US009352211B2

(12) United States Patent
Aoki et al.

(10) Patent No.: US 9,352,211 B2
(45) **Date of Patent: *May 31, 2016**

(54) LACROSSE GLOVE

(71) Applicant: Warrior Sports, Inc., Warren, MI (US)

(72) Inventors: Akio Aoki, Osaka (JP); Jocelyn Ventocilla, Laguna (PH)

(73) Assignee: Warrior Sports, Inc., Warren, MI (US)

( * ) Notice: Subject to any disclaimer, the term of this patent is extended or adjusted under 35 U.S.C. 154(b) by 264 days.

This patent is subject to a terminal disclaimer.

(21) Appl. No.: 14/291,470

(22) Filed: May 30, 2014

(65) Prior Publication Data

US 2014/0259282 A1 Sep. 18, 2014

Related U.S. Application Data

(63) Continuation of application No. 13/113,260, filed on May 23, 2011, now Pat. No. 8,769,720.

(51) Int. Cl.

| | |
|---|---|
| ***A41D 19/00*** | (2006.01) |
| ***A63B 71/14*** | (2006.01) |
| *A41D 19/015* | (2006.01) |

(52) U.S. Cl.

CPC ..... *A63B 71/141* (2013.01); *A63B 71/143* (2013.01); *A41D 19/015* (2013.01); *A63B 2102/14* (2015.10)

(58) Field of Classification Search

USPC ..... 2/159–160, 161.1, 161.6, 162–163, 2/158, 16, 20, 161.2, 161.5, 161.7

See application file for complete search history.

(56) References Cited

U.S. PATENT DOCUMENTS

| | | | | |
|---|---|---|---|---|
| 889,397 | A | 6/1908 | O'Shaughnessy | |
| 1,841,193 | A | 1/1932 | Lidston | |
| 4,497,073 | A | 2/1985 | Deutsch | |
| 4,768,234 | A | 9/1988 | Yamamoto | |
| 4,815,147 | A | 3/1989 | Gazzano et al. | |
| 4,930,162 | A | 6/1990 | Cote | |
| 5,511,243 | A | 4/1996 | Hall et al. | |
| 5,745,916 | A | 5/1998 | Linner | |
| 5,983,396 | A | 11/1999 | Morrow et al. | |
| 6,059,694 | A | 5/2000 | Villepigue | |
| 6,085,354 | A | 7/2000 | Wilder et al. | |
| 6,088,835 | A * | 7/2000 | Perkins | A41D 19/01558 2/161.1 |

(Continued)

FOREIGN PATENT DOCUMENTS

| | | |
|---|---|---|
| GB | 2311929 | 10/1997 |
| WO | WO2010/018552 | * 2/2010 |

*Primary Examiner* — Andrew W Collins
*Assistant Examiner* — Brieanna Szafran
(74) *Attorney, Agent, or Firm* — Warner Norcross & Judd LLP

(57) ABSTRACT

The present invention provides a glove comprises a main body adapted to receive a wearer's hand and a wrist cuff suspended over the main body. The main body further comprises a plurality of finger parts and a back hand part. The back hand part comprises a first protective panel hingedly connected at one end to the main body so that the first protective panel is suspend over the main body and slidably overlapped with a second protective panel. As the first protective panel slides over the second protective panel following the bending action of the fingers, a coordinated movement of the hand can be achieved. The second protective panel is also hingedly connected to the main body suspended over the main body and the wrist cuff, which allows for more coordinated rotating movement of the hand and the wrist following the bending action of the fingers.

15 Claims, 13 Drawing Sheets

(56) References Cited

U.S. PATENT DOCUMENTS

| | | | |
|---|---|---|---|
| D462,146 | S | 8/2002 | Aoki |
| 7,318,241 | B2 | 1/2008 | Morrow |
| 8,356,366 | B2 | 1/2013 | Fiegener et al. |
| 2005/0091721 | A1 | 5/2005 | Best |
| 2005/0251893 | A1 | 11/2005 | Hayden et al. |
| 2007/0220655 | A1 | 9/2007 | Aoki |
| 2008/0083048 | A1 | 4/2008 | Morrow et al. |
| 2008/0120753 | A1 | 5/2008 | Desjardins et al. |
| 2008/0222763 | A1 | 9/2008 | Jourde et al. |
| 2009/0019618 | A1 | 1/2009 | Winningham |
| 2010/0058513 | A1 | 3/2010 | Drosihn et al. |
| 2011/0067165 | A1 | 3/2011 | Fream et al. |
| 2011/0131703 | A1 | 6/2011 | Mazzarolo |
| 2012/0131716 | A1 | 5/2012 | Copeland et al. |
| 2012/0204304 | A1 | 8/2012 | Pechtold |
| 2013/0061369 | A1 | 3/2013 | Lim |

* cited by examiner

LACROSSE GLOVE

BACKGROUND OF THE INVENTION

1. Field of the Invention

This invention is related generally to a protective athletic glove and more particularly a lacrosse glove with improved flexibility, protection, and comfort.

2. Description of the Related Art

Gloves used in lacrosse are necessarily designed to hold a stick with a strong grip in order to receive and throw a ball with a handle of the stick whose wedge is provided with a net portion. Thus, stick handling is essential for ball control in lacrosse. At the same instant, players use the stick to knock the ball out of the net and often hit the parson carrying the ball in the hands and wrists. Therefore, the gloves should not restrict the hand and wrist movement and allow the hand to open and close with ease, but also are required to have a superior impact resistance with respect to the hands and the wrists. Also the gloves should be light weight for easy maneuvering of the hand and with adequate ventilation to allow air flow for comfort.

The gloves are usually made of wear resistant material. In order to protect the hands and the wrists from injury, a thick impact alleviating member serving to absorb and alleviate any impact imposed on the hand is inserted mainly on a back hand part of the glove. The impact alleviating member is formed from a formed material made of resin and provided around a wrist part, in a back hand part, and on the back finger parts of the glove. Although the wear resistant material and the impact alleviating members provide some protection, the impact alleviating members greatly decrease the comfort and flexibility. In particular, the wear resistant material causes the player's hand to become hot and lead to perspiration due to a lack of adequate ventilation, and the thick impact alleviating member restrict bending action of fingers and wrists.

Accordingly, improvements are desirable to provide a superior impact resistance with respect to the hands and the wrists along with comfort, without deteriorating the maneuverability thereof.

SUMMARY OF THE INVENTION

The present invention implements suspended movable protective back hand panels, suspended protective wrist cuff, multi pieces flex thumb, a back hand part having breathable fabric exposed, and spiked back fingers to provide, at least one of the following, significantly lighter weight glove capable of handling the stick, allowing the fingers to bend easily following the knuckle breaks, a better air circulation, and for the hand to flexibly open and close with ease while reliably protect the fingers and the hand by alleviating the impact to the hand.

A glove in accordance with this invention comprises a main body adapted to receive a wearer's hand and a wrist cuff suspended over the main body. The main body further comprises a plurality of finger parts and a back hand part. The glove further comprises a first protective panel hingedly connected at one end to the main body so that the first protective panel is suspend over the main body and slidably overlapped with a second protective panel. As the first protective panel slides over the second protective panel following the bending action of the fingers, a coordinated movement of the hand can be achieved.

The second protective panel is also hingedly connected to the main body suspended over the main body and the wrist cuff, which allows for more coordinated rotating movement of the hand and the wrist following the bending action of the fingers.

The present invention also provides an improved glove having spiked finger pieces on each of said plurality of finger parts. The spiked structure of the back finger offers stronger impact resistance compared to the traditional flat finger pieces. The spiked finger pieces comprise a foam structure which is individually attached to the back finger part so as to allow maximum bending action of the fingers and a better bending movement of the fingers as it grips the stick, while traditional interconnected flat finger pieces restrict bending action of fingers.

The present invention also provides an improved glove comprising the back hand part having breathable fabric exposed so as to provide adequate ventilation for comfort without compromising impact resistance.

These and other objects, advantages, and features of the invention will be more fully understood and appreciated by reference to the description of the current embodiment and the drawings.

Before the embodiments are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

The present invention is described with reference to drawings. It is to be understood that the drawings are diagrammatic and schematic representations of particular embodiments of the present invention, and are not limiting, nor are they drawn to scale. Although a lacrosse glove is described, the lacrosse glove of the present invention can be used for other type of athletic activities as well, such as for example in other contact stick sports like ice or roller hockey.

Figure 1B:
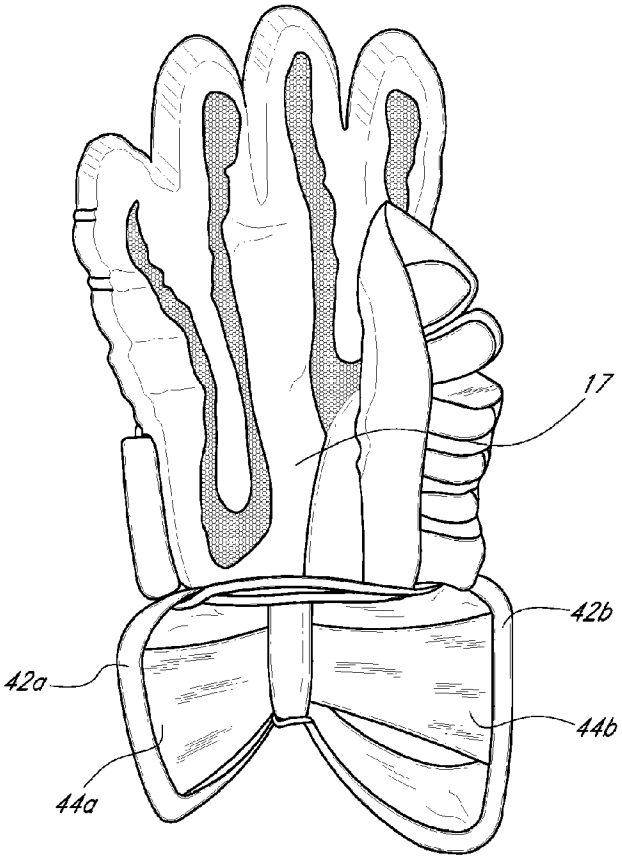
FIG. 1B is a front view of a lacrosse glove in accordance with the invention.
Figure 1A:
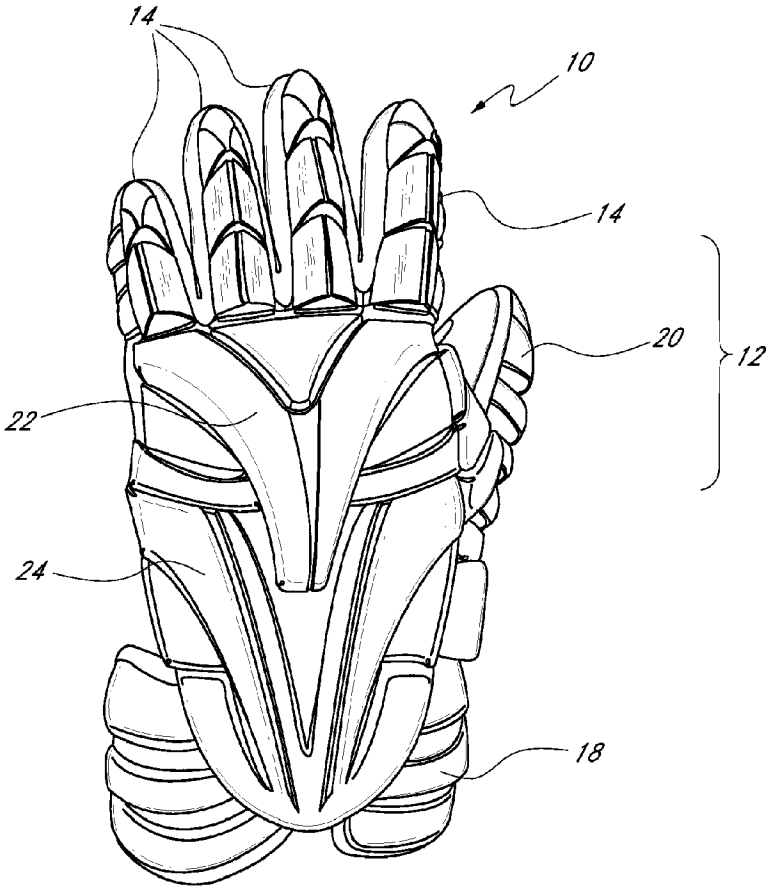
FIG. 1A is a back view of a lacrosse glove in accordance with the invention.

Referring to FIG. 1A, a back view of a lacrosse glove is shown in a left-handed glove. However, the present invention is not limited to the left-handed glove. A right-handed glove would be substantially identical to the left-handed glove. The lacrosse glove 10 comprises a main body 12 which is adapted to receive a wearer's hand and a wrist cuff 18 hingedly connected to edge of the main body 12. The main body 12 further comprises finger parts 14, a thumb part 20, a back hand part 16, and a front hand part 17. The main body 12 can be made of any suitable material or materials known in the art, whether natural or synthetic, which include but are not limited to fabrics, felt, rubber, latex, leather, or synthetic leather. If breathable material such as mesh fabrics is used, the front hand part 17 is often strategically covered by durable material for wear resistance as shown in FIG. 1B.

Figure 11A:
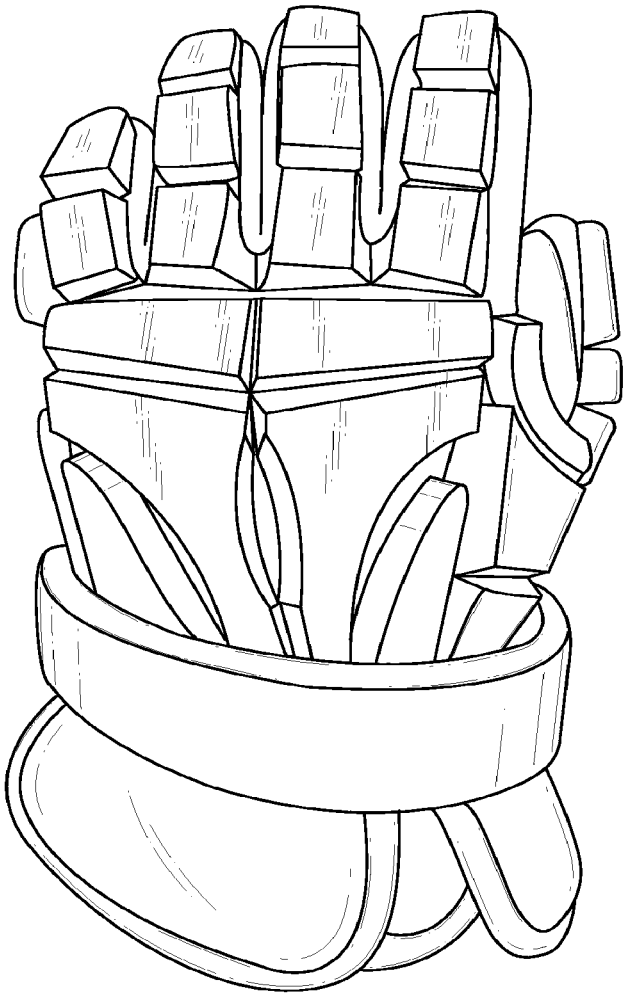
FIG. 11A (PRIOR ART)
FIG. 11A is a back view of a prior art lacrosse glove.
Figure 11C:
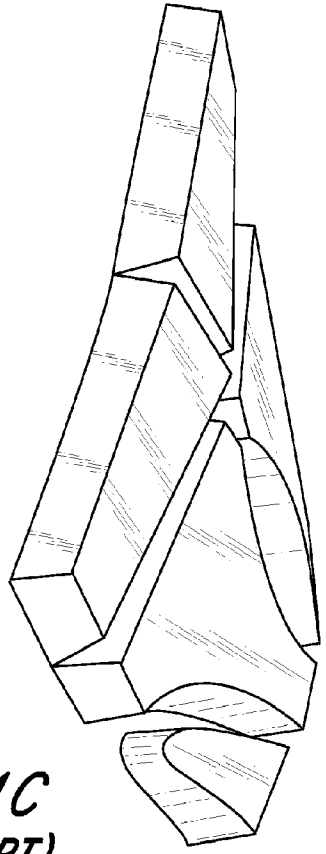
FIG. 11C (PRIOR ART)
FIG. 11C is a perspective view of prior art back hand part.
Figure 11B:
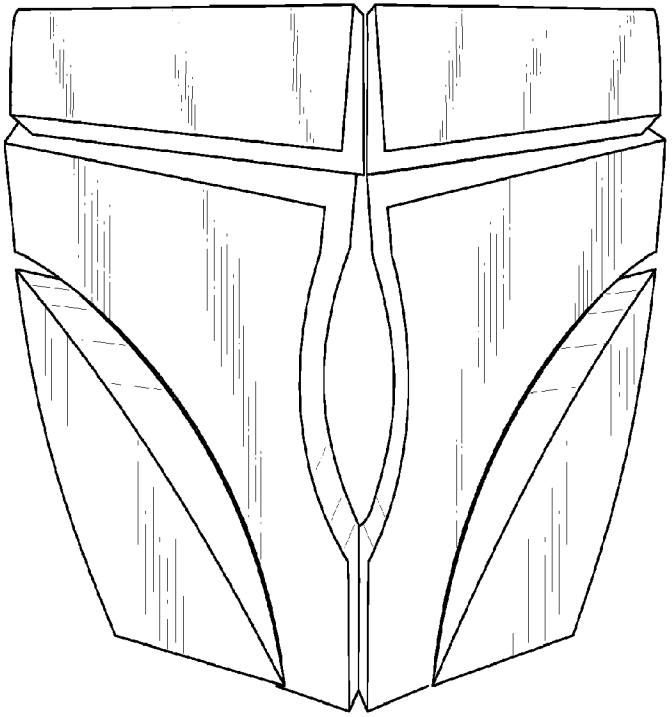
FIG. 11B (PRIOR ART)
FIG. 11B is a plan view of prior art back hand part.
Figure 12A:
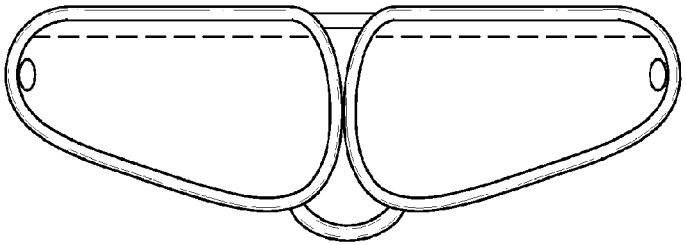
FIG. 12A (PRIOR ART)
FIG. 12A is a front spread view of a prior art wrist cuff.
Figure 12C:
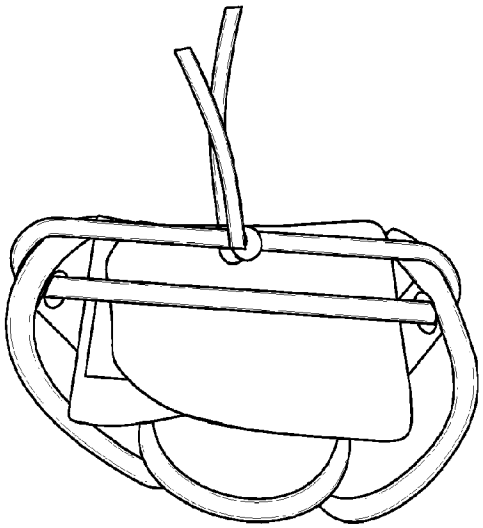
FIG. 12C (PRIOR ART)
FIG. 12C is a rear view of a prior art wrist cuff.
Figure 12B:
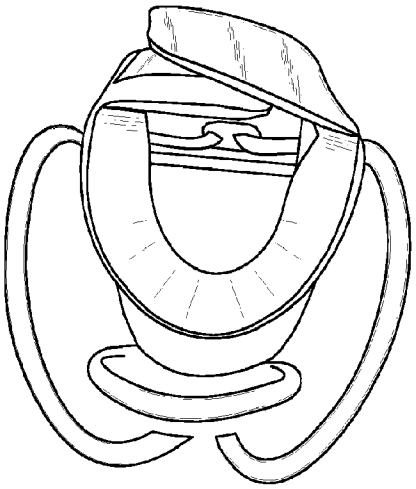
FIG. 12B (PRIOR ART)
FIG. 12B is a bottom view of a prior art wrist cuff.

Unlike traditional back hand part illustrated in FIGS. 11A, 11B, and 11C, the present invention comprises the first protective panel 22 and the second protective panel 24 over the back hand part 16. The first protective panel 22 directly hingedly connected to the main body 12 at one end so that the first protective panel is suspend over the main body 12 and slidably overlaps with the second protective panel 24. As the first protective panel 22 slides over the second protective panel 24 following the bending action of the fingers, a coordinated movement of the hand can be achieved.

The second protective panel 24 is hingedly connected to the main body 12 and suspended over the main body 12 and the wrist cuff 18. As the second protective panel 24 is suspended over a junction area of the main body 12 and the wrist cuff 18, the second protective panel 24 effectively alleviating the impact to the hand and wrist without a traditional floating wrist guard which is wrapped around the back hand of the glove and restricts the hand movement. An elimination of the traditional floating wrist guard allows for more coordinated rotating movement of the hand and the wrist following the bending action of the fingers.

Figure 2B:
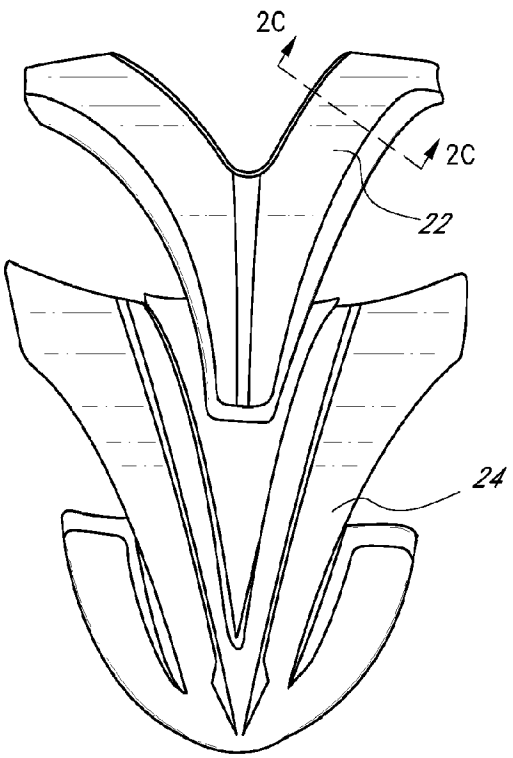
FIG. 2B is a plan view of the first protective panel and the second protective panel.
Figure 2C:
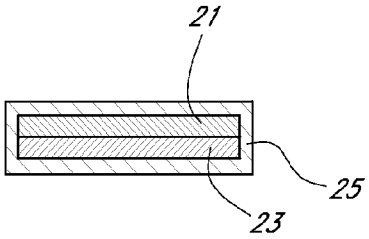
FIG. 2C is a sectional view of the first protective panel.
Figure 2A:
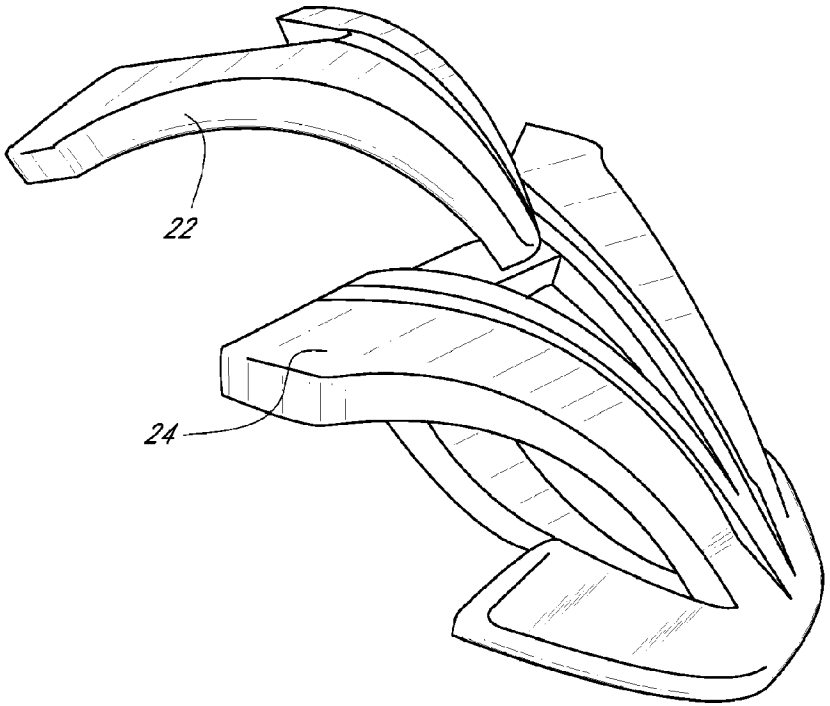
FIG. 2A is a perspective view of the first protective panel and the second protective panel.

Referring to FIGS. 2A and 2B, the first protective panel 22 and the second protective panel 24 comprises an arch-like member. The second protective panel 24 comprises at least two arch-like members which are arranged such that concave surfaces thereof are facing each other. The first and the second protective panels 22, 24 are preferably in V-like shape so as to create a lighter weight glove without compromising shock absorbing capability. As described in the latter part of the specification, the V-like shape along with other features of the present invention also helps to provide a passage for the ventilation.

The protective panels 22, 24 comprise a core material 21 and cover material 25. A soft cushioning material 23 is preferably provided for extra protection between the core material 21 and the cover material 25. In this particular embodiment, the soft cushioning material 23 is provided for only one side of the core material 21 as shown in FIG. 2C. However, the cushioning material can be provided both sides of the core material 21 or the core material 21 can be wrapped around by the cushioning material 23. As the cover material 25, durable material such as, but not limited to natural leather or a synthetic version thereof is preferably used. Alternatively, the fabrics can be used as the cover material on concave surfaces of the protective panels. The soft cushioning material 23 are preferably made of foamed resin. The core material may be made of rigid metal, plastic, composite material or any other suitable rigid and resilient material.

Figure 3:
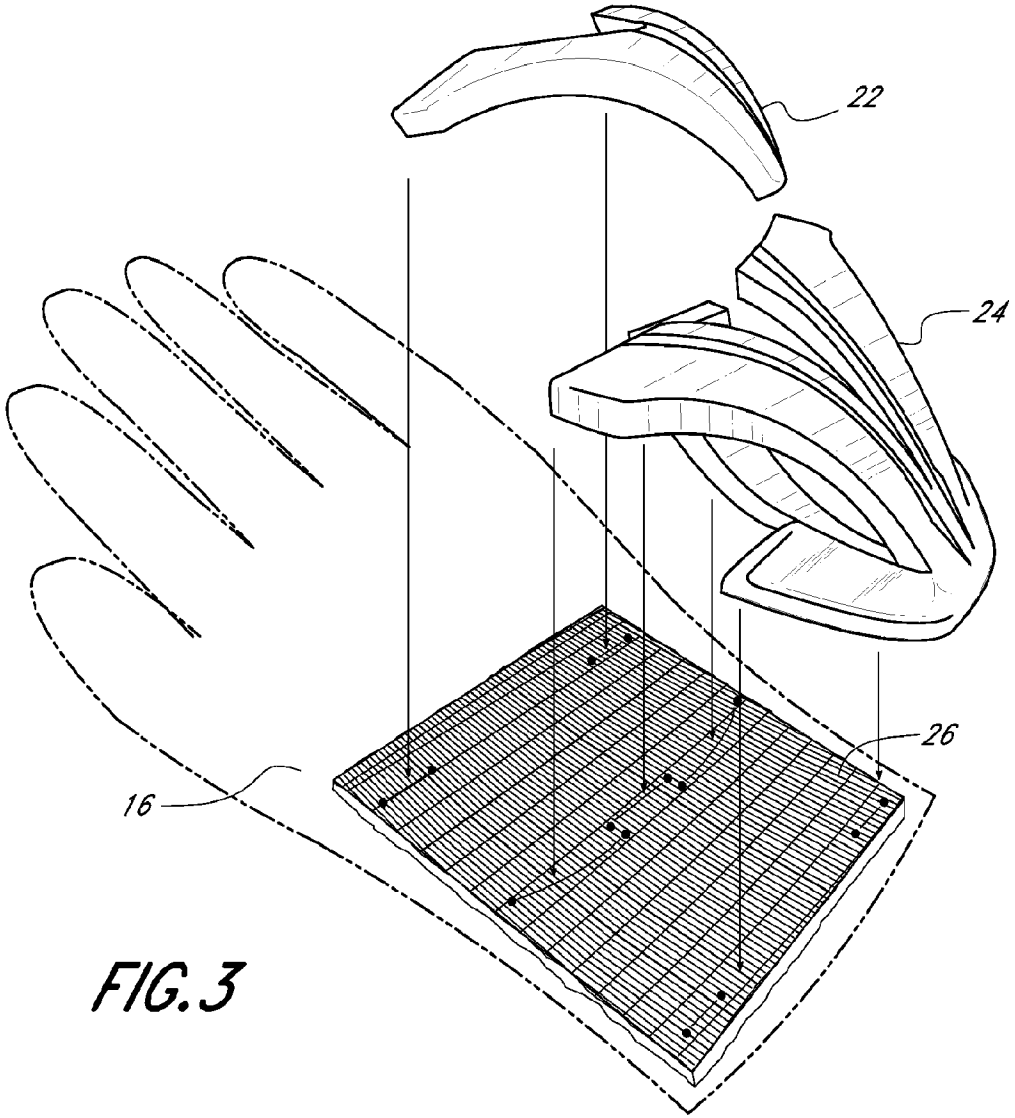
FIG. 3 is an explosion view of the back hand part.

Referring to FIG. 3, the first protective panel 22 hingedly connected at one end to the back hand part 16 such that a concave surface thereof is facing the back hand part 16, and has a narrowed end on the other end. The second protective panel 24 is connected to the main body 12 at least at one end and at the crest of the arch or the vicinity. These arch-like structures resist compression and provide sufficient protection to the back hand without using the thick impact alleviating member. Therefore, a lighter weight glove can be achieved without compromising impact resistance.

Figure 4:
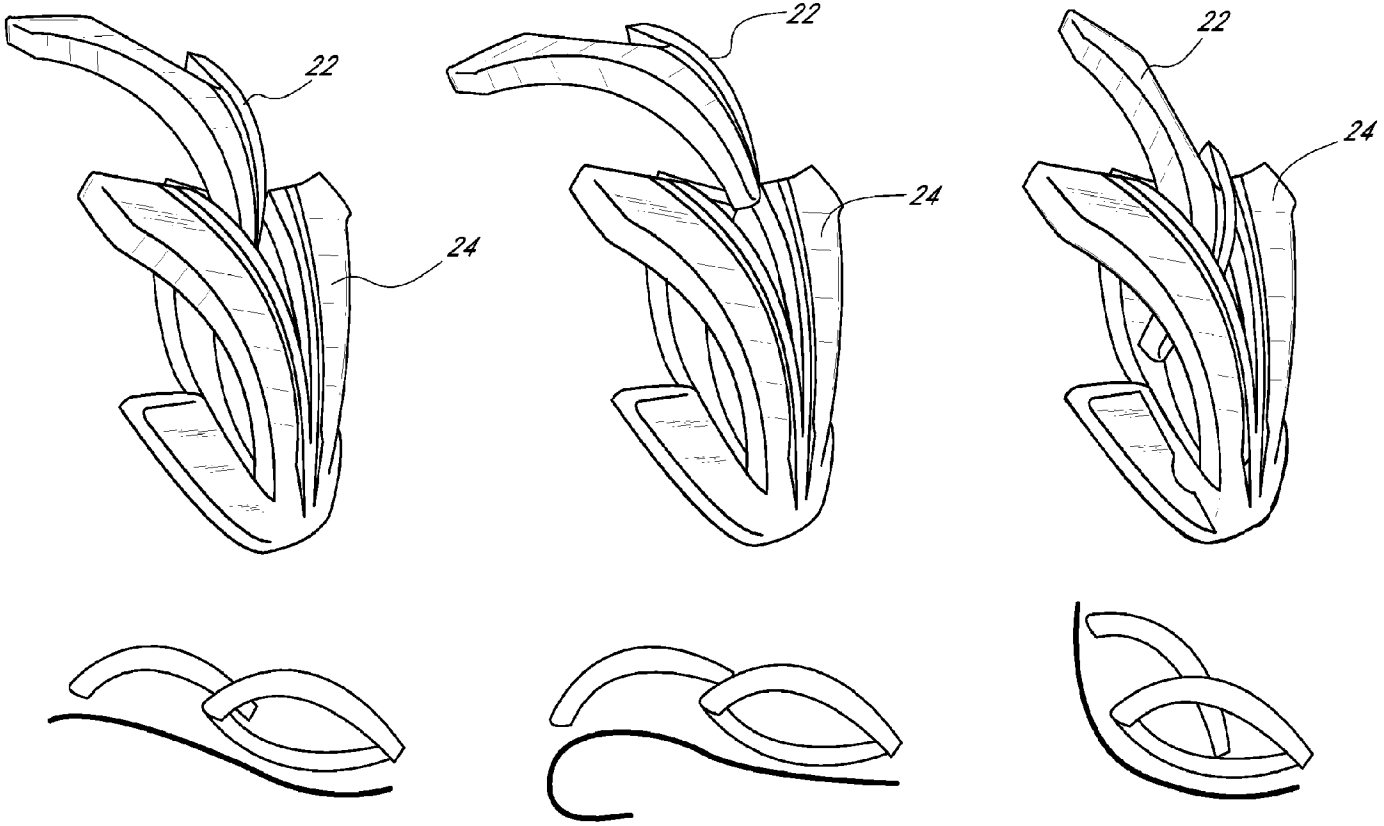
FIG. 4 is illustrating engagement of the first protective panel and second protective panel.

The back hand part 16 can also include a breathable material 26 exposed for ventilation in substantial area thereof. As the breathable material 26, permeable material such as, but not limited to mesh fabrics is preferably used. The breathable material spans under one end of the first protective panel to another location distal from the first protective panel under the second protective panel. Since a back hand side part needs to provide protection, it is not possible to expose the mesh fabric in the large part of the back hand part to obtain adequate ventilation without compromising the impact resistance in conventional lacrosse gloves. However, in accordance with the present invention, the first protective panel 22 and the second protective panel 24 having the arch like shape are suspended over the breathable material 26 so that the first protective panel 22 and the second protective panel 24 can provide a passage for the ventilation as illustrated in FIG. 3 and FIG. 4. Accordingly, the improved ventilation is achieved without sacrificing impact resistance.

Figures 5A, 5B:
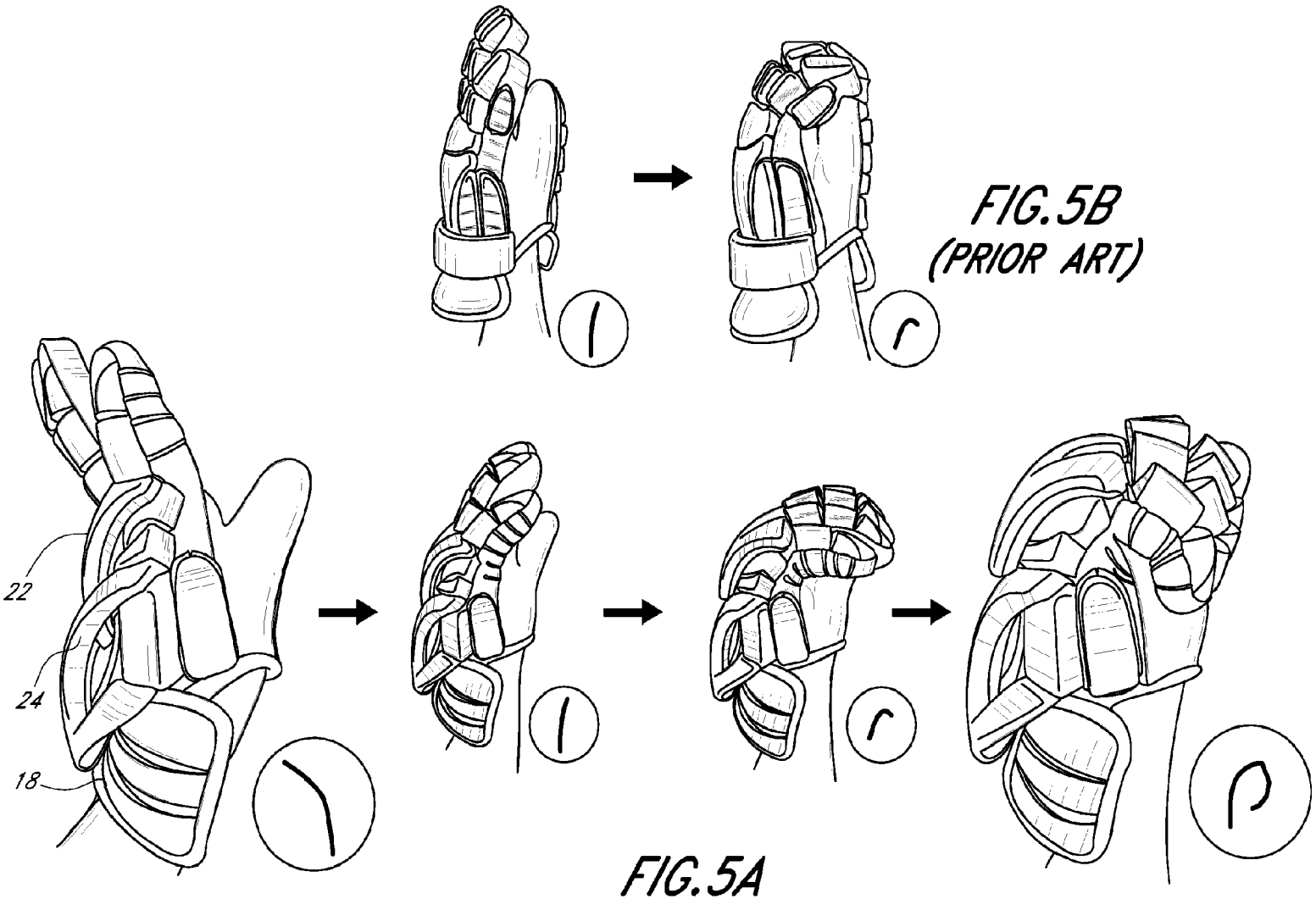
FIG. 5B (PRIOR ART)
FIG. 5A is illustrating a backward flexing of the lacrosse glove in accordance with the invention.
FIG. 5B is illustrating a backward flexing of a prior art.

Referring to FIG. 4, the second protective panel 24 includes a V-shaped opening to accommodate the narrowed end of the first protective panel 22 and the narrowed end slidably engages with and extends through the opening. This configuration provides more backward flexibility as compared to a conventional glove using one piece back hand as illustrated in FIG. 5B.

Figure 6B:
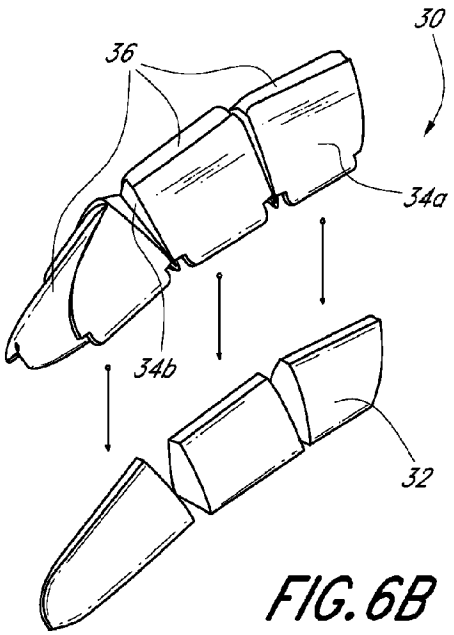
FIG. 6B is an exploded view of the spiked finger pieces.
Figure 6A:
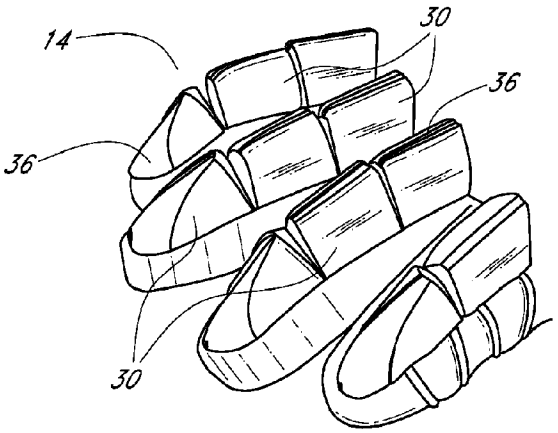
FIG. 6A is a perspective view of back finger parts with spiked finger pieces.
Figure 6C:
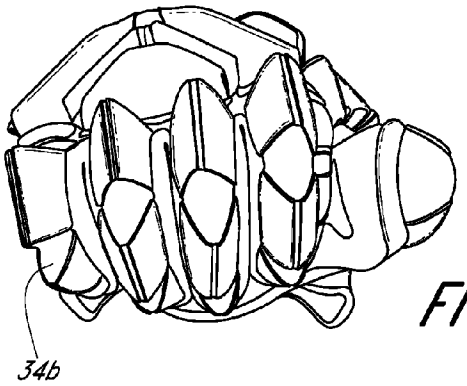
FIG. 6C is a perspective view of fisted back finger parts with spiked finger pieces.
Figure 7A:
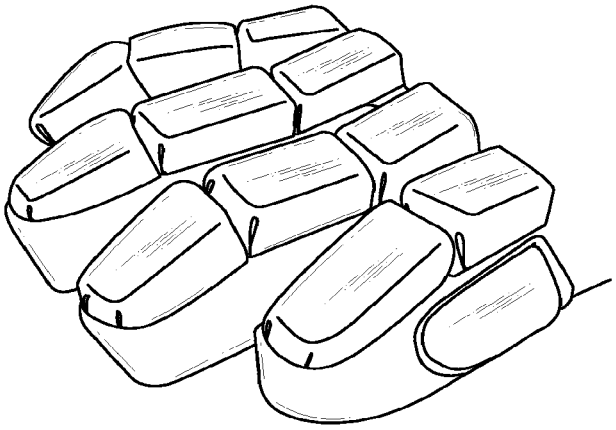
FIG. 7A (PRIOR ART)
FIG. 7A is a perspective view, of a prior art back finger pieces.
Figure 7B:
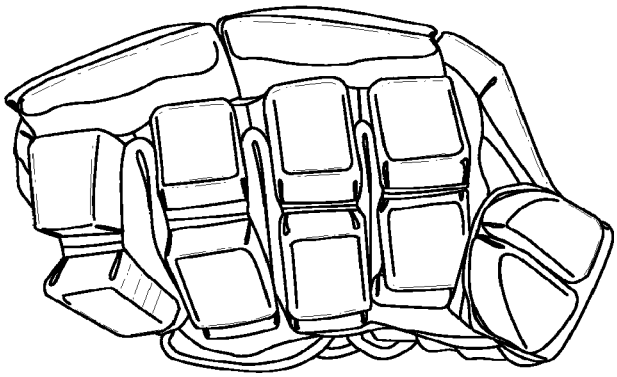
FIG. 7B (PRIOR ART)
FIG. 7B is a perspective view of a prior art fisted back finger pieces.

Referring to FIG. 6A, the finger parts 14 include a plurality of spiked finger piece 30 attached thereto so as to offer stronger impact resistance as compared to the traditional flat finger pieces illustrated in FIGS. 7A and 7B. The spiked finger pieces 30 comprise a foam structure 32 and are covered by a cover material 34*a*, except for spaces between the spiked finger pieces 30. The spaces between the spiked finger pieces 30 are covered by a cover material 34*b*. The foam structures 32 are individually attached to the back of the finger part 14 and the spaces between the spiked finger pieces 30 are positioned to be over a joint of each fingers of the wearer's hand when the glove is worn. These features provide the maximum bending action of the fingers so that the stick can be firmly held.

As the cover material 34*a*, durable material such as, but not limited to natural leather or a synthetic version thereof is preferably used. The cover material 34*b* can be made of the same material as 34*a*, but preferably made of fabrics to obtain more flexibility. The foam structures 32 are preferably made of foamed resin having a substantially triangular shape in section so as to have a higher impact resistance as compared to the traditional flat finger pieces.

Ridgelines and finger tip portions of the spike finger pieces comprise pad reinforcement 36 so that no joint line of the cover material 34*a* coincides with the ridgeline of the spike finger and the finger tip portion. Accordingly, an extra protection to the vulnerable portions can be provided. The pad reinforcement can be made of silicone, rubber, vinyl, polyvinyl chloride or the like.

Figure 8B:
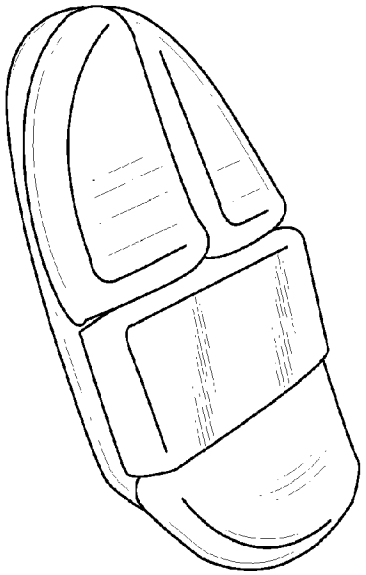
FIG. 8B (PRIOR ART)
FIG. 8B is a prior art thumb part.
Figure 8A:
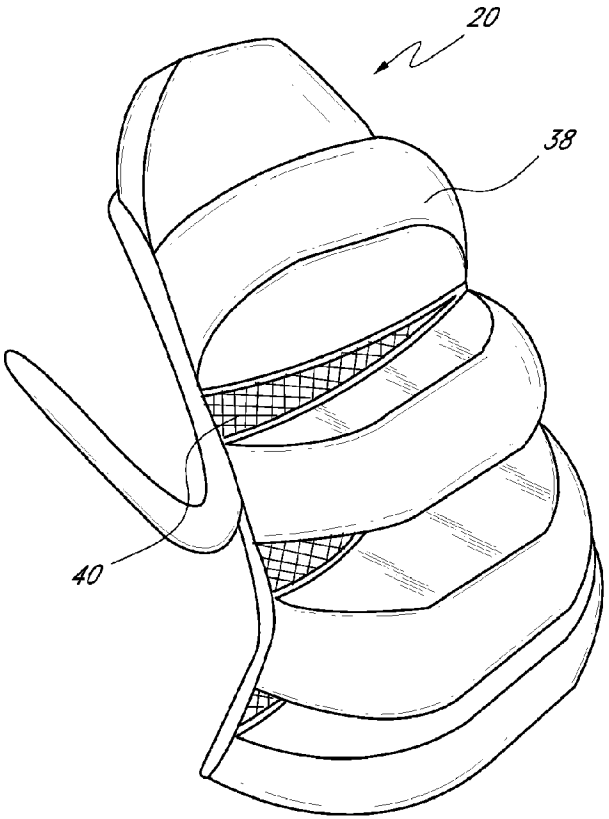
FIG. 8A is a perspective view of the thumb part.
Figure 9:
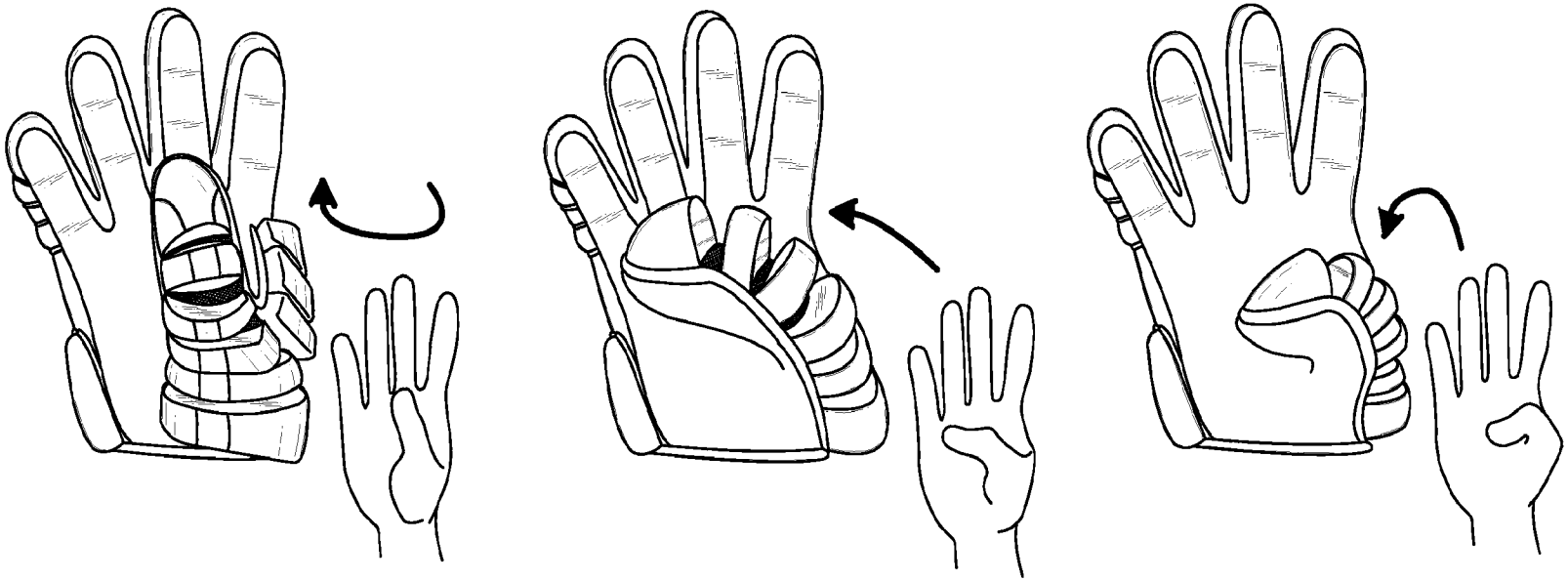
FIG. 9 is illustrating forward flexing of the thumb.
Figure 10A:
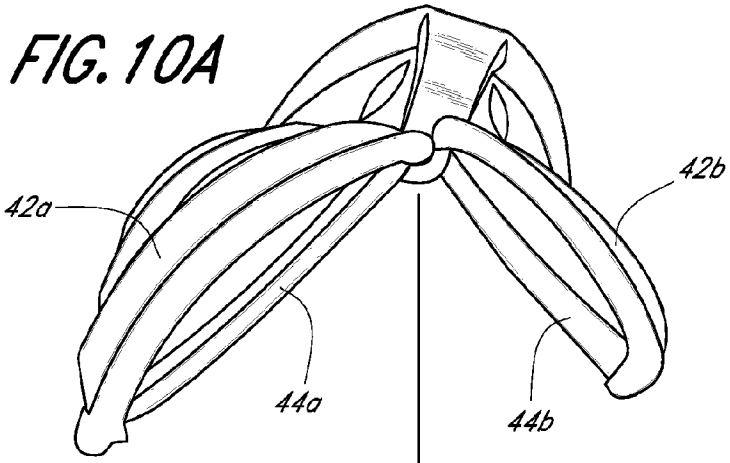
FIG. 10A is a perspective view of the suspended wrist cuff.
Figure 10B:
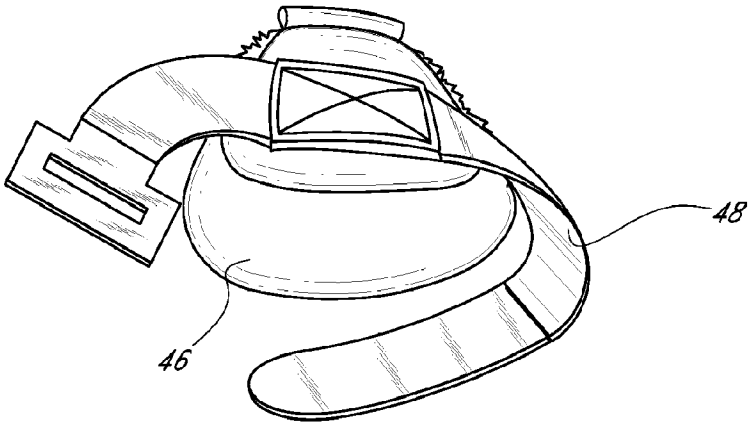
FIG. 10B is illustrating a padded wrist cradle with a belt attached thereto.
Figure 10C:
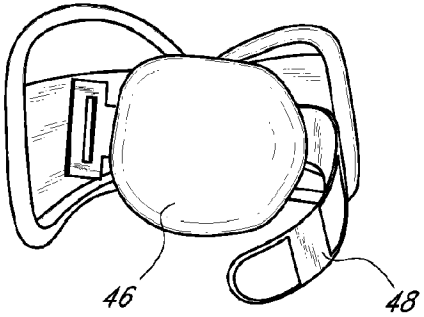
FIG. 10C is an interior perspective view of the wrist cuff with the padded wrist cradle and the belt.
Figure 10D:
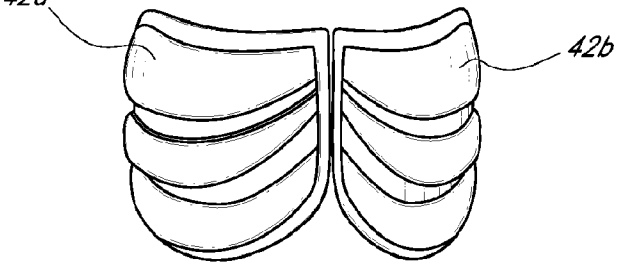
FIG. 10D is a front view of the wrist cuff.

Referring FIGS. 8A and 9, the thumb part 20 comprises a plurality of protective pieces 38. The protective pieces 38 are spread apart and a breathable material 40 are disposed across the spread apart gaps to allow for better forward flexing and ventilation. The protective pieces 38 are preferably arranged non-parallel so that the spread apart gaps have triangular-like shape. This configuration allows for better forward flexing of the thumb part 20. In particular, the thumb part 20 can roll over to the front hand part 17 with ease and track more closely to the natural movement of the wearer's thumb as illustrated in FIG. 9.

Unlike traditional one piece cover with flat top forms as illustrated in FIG. 8B, the spread apart configuration also allows better shock absorption while releasing the exerted force off the mesh area. Similar to the spiked finger pieces 30, the protective pieces 38 comprise a foam structure covered by a cover material, and pad reinforcement is preferably provided The breathable material such as, but not limited to mesh fabric can be used as the breathable material 40. The number of the protective pieces is not limited but preferably five pieces.

Referring FIGS. 10A, 10B, 10C, and 10D the wrist cuff 18 comprises a pair of side cuff members 42*a*, 42*b* having an arch-like shape hingedly connected each other and the wrist cuff 18 is disposed such that each of concave portion of side cuff members 42*a*, 42*b* is facing the wearer's wrist, and curvature of the side cuff members 42*a*, 42*b* is oriented with a circumferential of the wearer's wrist. Similar to the protective back panels 22, 24, the side cuff members 42*a*, 42*b* comprise a core material and a cover material. A soft cushioning material is preferably provided for extra protection between the core material and the cover material. As the cover material, durable material such as, but not limited to natural leather or a synthetic version thereof is preferably used. Alternatively, fabrics can be used as the cover material on concave surfaces of the side cuff members 42*a*, 42*b*. The soft cushioning material is preferably made of foamed resin. The core material may be made of rigid metal, plastic, composite material or any other suitable rigid and resilient material.

Each side cuff member 42*a*, 42*b* further comprises a cushioned cuff base 44*a*, 44*b* stretched across the both end of the arch-like shape. The cushioned cuff base 44*a*, 44*b* acts as a bottom code of the arch-like structure and carry tension, when impact is applied to the side cuff members 42*a*, 42*b*, so as to provide impact resistance without using the thick impact alleviating member. The cushioned cuff base 44*a*, 44*b* comprise elastic material such as thermoplastic, thermoset plastic, or any other suitable tensile strength material.

A padded wrist cradle 46 can be also included in the wrist cuff 18 for further protection. The padded wrist cradle comprises a foam structure and is covered by a cover material such as fabrics. Additionally, a belt 48 can be attached at the back of the cradle as well.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

What is claimed is:

1. A lacrosse glove comprising:

a main body adapted to receive a wearer's hand, the main body comprising finger parts, a thumb part and a back hand part;

a first panel connected at one end to the back hand part of the main body so as to suspend the first panel over the back hand part; and a second panel disposed over the back hand part of the main body, the second panel being connected to the main body at a location distal from the one end of the first panel, wherein the first panel is of a V-shaped configuration having a narrowed end, wherein the second panel defines an opening dimensioned so that the narrowed end of the V-shaped configuration of the first panel slidably engages with and extends into the opening defined by the second panel during backward flexing of the wearer's hand, to facilitate coordinated rotating movement of the wearer's hand and wrist following a bending action of a wearer's fingers, wherein the back hand part comprises a material disposed under and separated from a lower surface of the first panel, wherein the first panel is suspended over the material in an arch like manner, wherein the second panel comprises a concave surface, wherein the first panel includes a pad constructed from a cushion material disposed within a cover material, the pad extending in the narrowed end so that the pad extends into the opening defined by the second panel during backward flexion of the wearer's hand.

2. The lacrosse glove of claim 1 wherein the opening of the second panel is V-shaped and adapted to slidably receive the narrowed end therein.

3. The lacrosse glove of claim 1 wherein the second panel is disposed adjacent and is configured to provide protection to a wrist of the wearer, wherein the second panel includes another pad constructed from a cushion material disposed within the cover material.

4. The lacrosse glove of claim 1 wherein the finger parts comprise a plurality of spiked finger pieces attached on a back of the finger parts, wherein said spiked finger pieces are covered by a covered material and comprise a foam structure having a substantially triangular shape in section so as to form a ridgeline.

5. The lacrosse glove of claim 4 wherein spaces between the spiked finger pieces are configured to be positioned over a joint of each fingers of the wearer's hand when the glove is worn.

6. The lacrosse glove of claim 4 wherein the cover material of the spiked finger pieces comprises pad reinforcement at the ridgelines and fingertip portions thereof.

7. The lacrosse glove of claim 1 wherein the first panel is joined with the back hand part adjacent the finger parts.

8. The lacrosse glove of claim 7 wherein the thumb part comprises a plurality of protective pieces that spread apart during flexing.

9. The lacrosse glove of claim 1 comprising a pair of side cuff members hingedly connected each other adjacent the main body part.

10. The lacrosse glove of claim 9 wherein each side cuff member has an arch-like shape.

11. The lacrosse glove of claim 10 wherein each side cuff member further comprises a cushioned cuff base stretched across the arch-like shape.

12. The lacrosse glove of claim 1 wherein the second panel extends across the back hand part.

13. The lacrosse glove of claim 1 wherein the opening of the second panel is of a V-shaped configuration, wherein the narrowed end of the first panel extends through the opening in the second panel when the wearer's hand flexes backward.

14. The lacrosse glove of claim 1 wherein the material is breathable, wherein the material spans from the one end of the first panel to the location distal from the one end of the first panel.

15. The lacrosse glove of claim 1 wherein the second panel is of a concave shape.

* * * * *